US009529327B2

(12) United States Patent
Marcon

(10) Patent No.: US 9,529,327 B2
(45) Date of Patent: Dec. 27, 2016

(54) CROWN PULLING DEVICE FOR WATCHES

(71) Applicant: HI-TEK OFFICE S.R.L., Lucca (IT)

(72) Inventor: Luca Marcon, Bessica di Loria (IT)

(73) Assignee: HI-TEK OFFICE S.R.L., Lucca (IT)

( * ) Notice: Subject to any disclaimer, the term of this patent is extended or adjusted under 35 U.S.C. 154(b) by 0 days.

(21) Appl. No.: 14/786,302

(22) PCT Filed: Apr. 23, 2014

(86) PCT No.: PCT/IB2014/060926
§ 371 (c)(1),
(2) Date: Oct. 22, 2015

(87) PCT Pub. No.: WO2014/174448
PCT Pub. Date: Oct. 30, 2014

(65) Prior Publication Data

US 2016/0103420 A1 Apr. 14, 2016

(30) Foreign Application Priority Data

Apr. 23, 2013 (IT) ..... FI2013A0090

(51) Int. Cl.
*G04B 3/04* (2006.01)
*G04B 37/10* (2006.01)

(52) U.S. Cl.
CPC ..... *G04B 3/043* (2013.01); *G04B 3/045* (2013.01); *G04B 37/103* (2013.01)

(58) Field of Classification Search
CPC ..... G04B 27/045; G04B 27/002; G04B 3/045; G04B 37/103
See application file for complete search history.

(56) References Cited

U.S. PATENT DOCUMENTS

| | | | | |
|---|---|---|---|---|
| 1,521,208 | A | 12/1924 | Von Kersburg | |
| 2,082,843 | A * | 6/1937 | Mathez | G04B 27/045 368/192 |
| 7,404,669 | B2 * | 7/2008 | Lambert | G04B 27/002 368/319 |
| 7,517,139 | B2 * | 4/2009 | Hiranuma | G04B 37/081 368/288 |
| 7,648,266 | B2 * | 1/2010 | Saunier | G04B 3/043 368/286 |
| 7,942,574 | B2 * | 5/2011 | Hozumi | G04B 3/043 368/308 |
| 2008/0025158 | A1 | 1/2008 | Hiranuma | |

FOREIGN PATENT DOCUMENTS

| | | |
|---|---|---|
| CH | 316833 | 10/1956 |
| CH | 320663 | 3/1957 |
| CH | 0378867 | 7/1990 |
| CH | 698846 | 11/2009 |
| JP | S49137564 U | 11/1974 |
| JP | S512998 Y | 1/1976 |
| WO | 2008/072020 | 6/2008 |

OTHER PUBLICATIONS

International Search Report and Written Opinion dated Mar. 16, 2015 for corresponding international patent application No. PCT/IB2014/060926.

* cited by examiner

*Primary Examiner* — Sean Kayes
(74) *Attorney, Agent, or Firm* — Abelman, Frayne & Schwab

(57) ABSTRACT

A device for protecting the crown (17) of a watch comprising a lever (18) which allows the crown to be pulled out.

3 Claims, 3 Drawing Sheets

CROWN PULLING DEVICE FOR WATCHES

CROSS REFERENCE TO RELATED APPLICATIONS

This application is a national phase of PCT application No. PCT/IB2014/060926, filed Apr. 23, 2014, which claims priority to IT patent application No. FI2013A000090, filed Apr. 23, 2013, all of which are incorporated herein by reference thereto.

FIELD OF THE INVENTION

The present invention relates to the field of watches, and in particular to devices for the protection of watch parts.

STATE OF THE ART

A particularly delicate part of watches, and particularly wrist watches, is the crown, which can be easily damaged, for example as a result of a knock, or it can be accidentally moved by the user; furthermore, the crown is also one of the weak points of a watch in terms of waterproofing.

To solve this problem, several crown protection devices are known, schematically shown in FIG. 3, which when applied to the watch case enable a crown cover to be screwed onto the crown to protect it from the above-mentioned possible accidents.

As can be seen from FIG. 3, the crown-cover devices belonging to the state of the art generally comprise an arm 10, one end of which is capable of rotating around a pin 11 firmly fixed to the watch case 12, or to a projection from it. At the end of said arm 10, opposite the end fixed to the case, there is a cap 13 inserted into a support element 14 (allowing the rotation of said cap 13) and this support element, in turn, is adapted to turn around a pin 15.

Said cap 13 is adapted to engage, by means of screwing, with a thread 16 positioned under the crown 17 and integral with the case 12 so as to cover and protect said crown 17.

As can be seen from FIG. 3, and as is in any case self-evident, in the device described above, the thread 16 onto which the cap 13 has to screw must have a diameter larger than that of the crown 17; this means that, after unscrewing the cap 13, when the user tries to pull out the crown 17 (for example to set the time or perform other functions controlled by the crown) in reality his or her fingers automatically grip the thread 16 instead of the crown 17. Therefore, pulling out the crown can generally become a rather uncomfortable operation requiring the user to make several attempts before being successful.

SUMMARY OF THE INVENTION

A crown-covering device is described comprising a lever enabling the crown to be pulled out without acting directly on it.

DETAILED DESCRIPTION OF THE INVENTION

The present invention resolves the above-mentioned problem thanks to a crown-covering device comprising a lever enabling the crown to be pulled out without acting directly on it.

Figure 1:
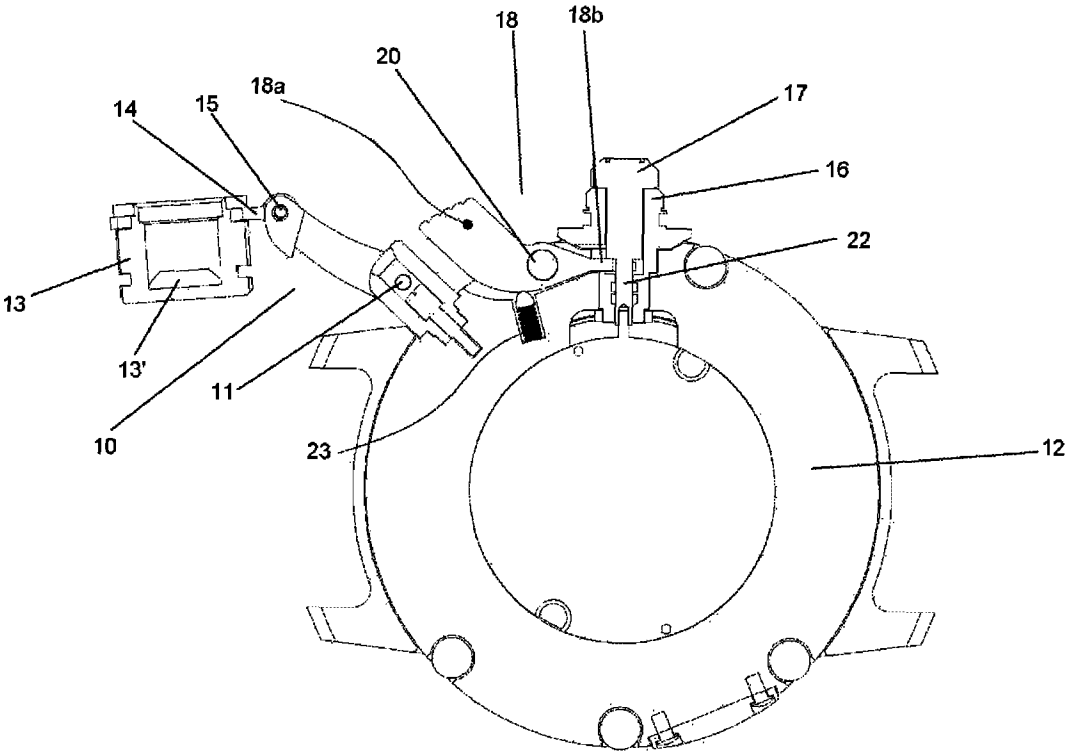
FIG. 1 shows a cross-section schematic view of the device according to the invention.
Figure 2:
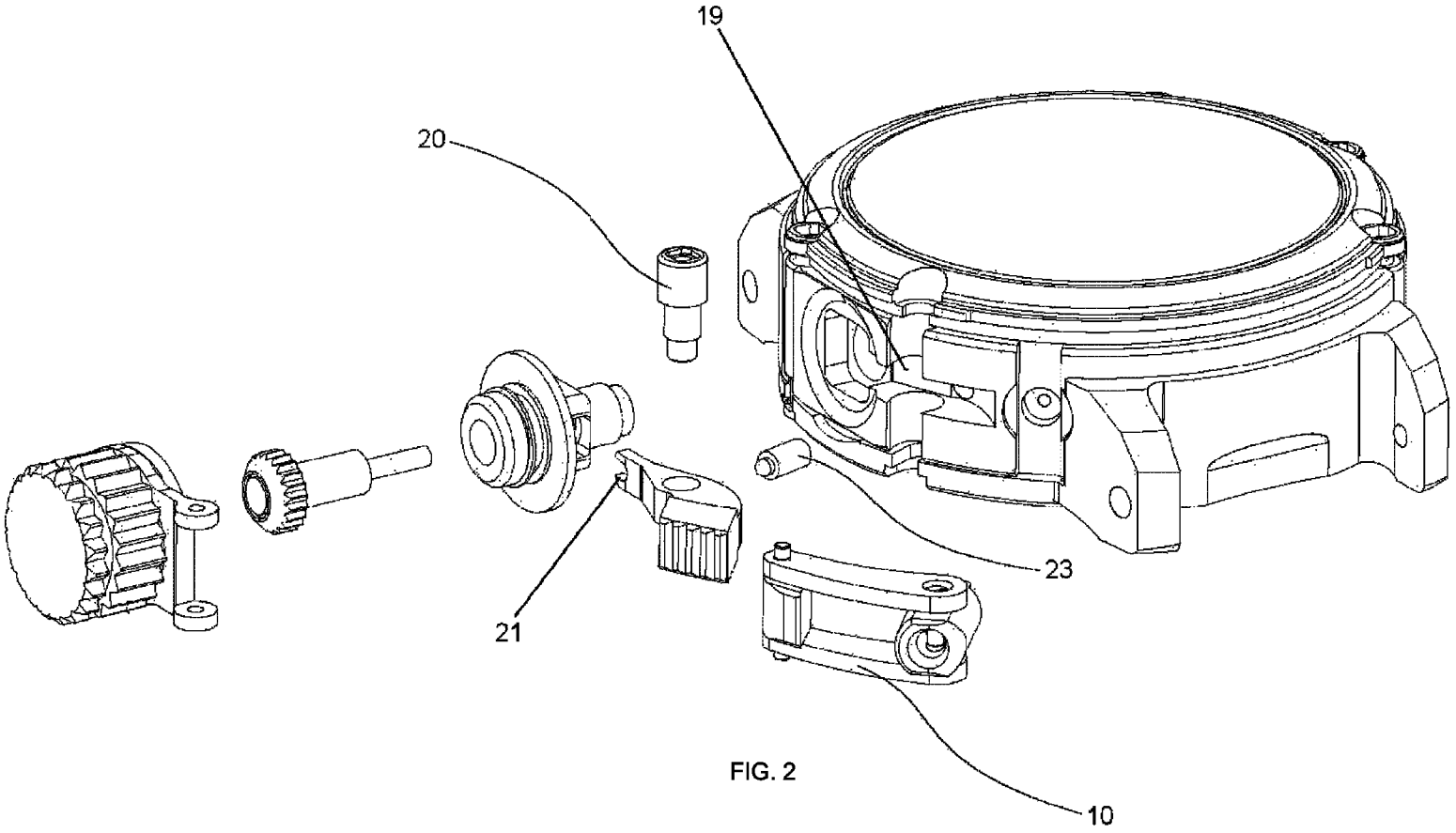
FIG. 2 shows an exploded view of the device according to the invention.
Figure 3:
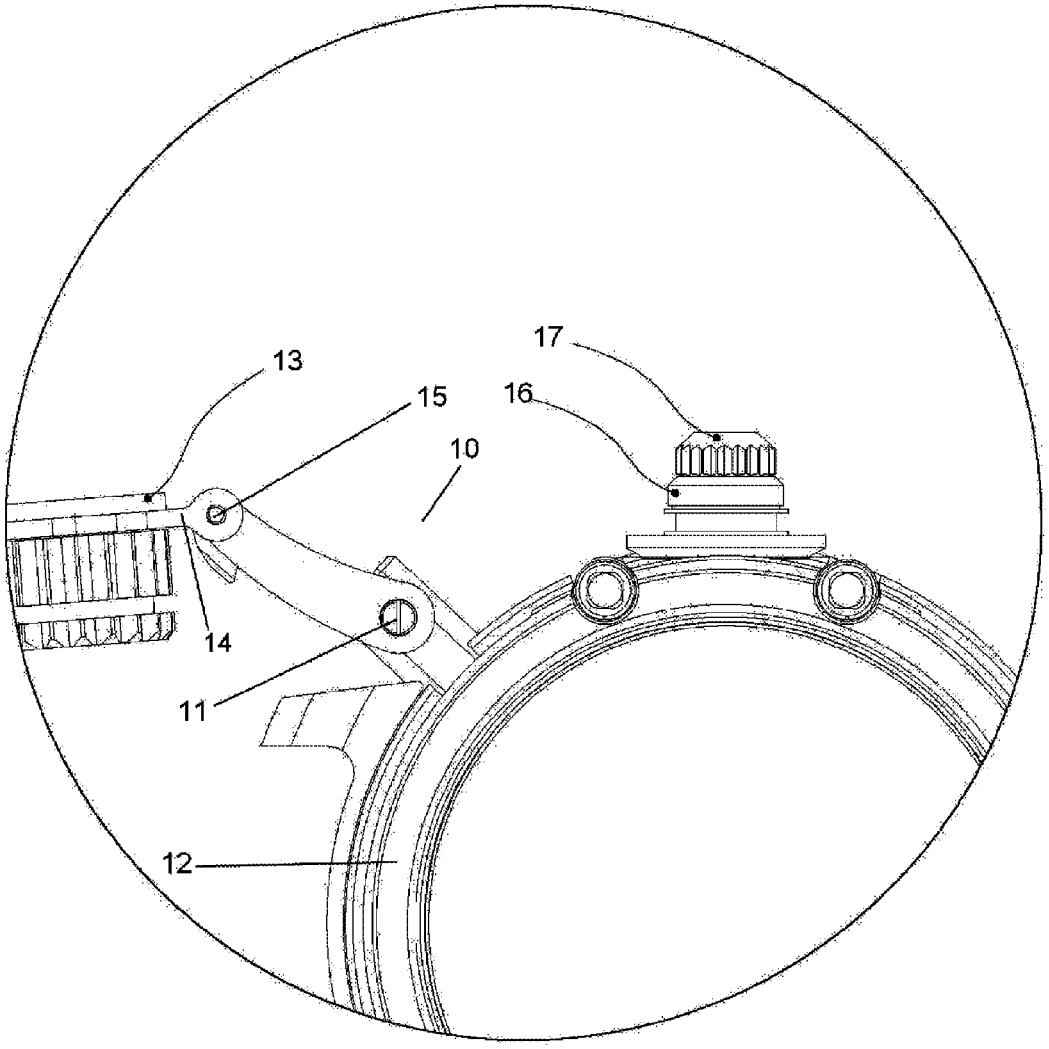
FIG. 3 shows a schematic view of a known crown-covering device.

As can be seen from FIG. 1, the crown-covering device according to the invention consists (like known devices) of an arm 10, one end of which is capable of rotating around a pin 11 firmly fixed to the watch case 12, or to a projection from it, while having at the end opposite the end fixed to the case a cap 13 inserted into a support element 14 (allowing rotation on itself), this support element also being able to rotate around a pin 15; if preferred, said cap 13 may contain an elastic shim 13' that can help to compress the crown in its rest position.

The cap 13 is capable of engaging, by means of screwing, with a thread 16 positioned under the crown 17 and integral with the case 12, so as to cover and thereby protect said crown 17.

Furthermore, the device according to the invention comprises a lever 18 housed in a corresponding cavity 19 made on the edge of the watch case 12, the fulcrum of which consists of a shaft 20 firmly fixed to the watch case 12 and perpendicular to its surface.

The first end 18*a* of said lever 18 is housed in an opening in the arm 10 of said crown-cover and is made available to be operated by the user when said cap 13 is removed from the crown 17. The second end 18*b* of said lever 18 is adapted to engage with a housing made under said crown 17, so as to push said crown 17 upwards when the user applies sufficient pressure on the first end 18*a* of said lever 18. Said second end 18*b* of said lever 18 preferably comprises two prongs 21 adapted to receive the shaft supporting the crown 22 and to exert on said shaft the force needed to pull out the crown 17.

Furthermore, a ball spring 23 adapted to act on said first end 18*a* of said lever 18 is then inserted into the cavity 19 of the case so as to keep the lever in the inactive position (i.e. with the crown not pulled out).

Operation of the device according to the invention is intuitive and extremely simple.

Once the cap 14 is unscrewed, the user, by acting on the lever 18, causes the crown 17 to be pulled out and, once the lever is released, the ball spring 23 acting on the lever 18 returns it to the rest position while the crown 17 remains pulled out. Once the necessary operations have been performed, the user can then push the crown back in and screw on the cap 13 by engaging it with the thread 16.

The invention claimed is:

1. A crown-covering device having an arm (10), one end of which is capable of rotating around a pin (11) firmly fixed to a watch case (12), or to a projection from the watch case (12), while having at the end opposite the end fixed to the case a cap (13) inserted into a support element (14), allowing rotation on the support element (14), this support element also being able to rotate around a pin (15) and adapted to engage, by means of screwing, with a thread (16) positioned under the crown (17) and integral with the case (12), characterized in that the crown-covering device comprises a lever (18) housed in a cavity (19) made on the edge of the watch case (12), a fulcrum of which includes a shaft (20) firmly fixed to the watch case (12) and perpendicular to a surface of the watch case (12) characterized in that one end (18*a*) of said lever (18) is housed in an opening in the arm (10) of the crown-cover so as to allow operation by a user while the other arm (18*b*) is inserted under the crown (17).

2. Device according to claim 1 wherein said arm which is inserted under the crown (17) comprises two prongs (21) adapted to receive the shaft supporting the crown (22).

3. Device according to claim 1 comprising a ball spring (23), inserted into the cavity (19) and adapted to act on an outer arm of the lever (18), thereby keeping the lever in an inactive position.

* * * * *